United States Patent [19]

Lanzetta

[11] 4,146,599

[45] Mar. 27, 1979

[54] DEVICE FOR APPLYING EXPOSED AGGREGATE AND METHOD OF APPLYING SAID AGGREGATE

[76] Inventor: John B. Lanzetta, 17 2B Lake Shore Park Apartments, Watervliet, N.Y. 12189

[21] Appl. No.: 732,456

[22] Filed: Oct. 14, 1976

[51] Int. Cl.[2] ..... E04F 13/14

[52] U.S. Cl. ..... 264/35; 52/315; 249/15; 249/55; 264/256; 264/316

[58] Field of Search ..... 249/15, 16, 55, 96; 264/31, 35, 261, 313, 316, 256; 52/127, 315, 746; 428/315, 316

[56] References Cited

U.S. PATENT DOCUMENTS

| | | | |
|---|---|---|---|
| 985,353 | 2/1911 | Landis | 264/261 |
| 1,211,632 | 1/1917 | Shaw | 264/261 |
| 1,931,573 | 10/1933 | Cooper | 156/230 |
| 3,441,457 | 4/1969 | Regnaud | 264/31 X |
| 3,542,638 | 11/1970 | Kenny | 428/315 X |
| 4,037,013 | 7/1977 | Sprague | 428/315 X |

*Primary Examiner*—Thomas P. Pavelko
*Attorney, Agent, or Firm*—James J. McKeever

[57] ABSTRACT

A device for applying exposed aggregate, which is utilized on the exterior and interior of building and home construction, as well as other structures, has been developed that consists of a rigid to flexible type backing with a resilient material such as foam or the like attached thereto forming the face of the device. It is essential to the device of the present invention that the resilient material forming the face of the device has sufficient resiliency to insure that aggregate that is placed thereon will not easily roll off the face of said device and yet in no way inhibit the adhesion of the exposed aggregate on a prepared surface when applied. In utilizing the device of the present invention and in carrying out the method of the present invention, aggregate is placed on the face of any number of devices of the present invention and such devices are used to directly apply aggregate to a surface such as a wall which has been prepared to receive exposed aggregate.

4 Claims, 2 Drawing Figures

DEVICE FOR APPLYING EXPOSED AGGREGATE AND METHOD OF APPLYING SAID AGGREGATE

SUMMARY OF INVENTION

Briefly stated, the present invention relates to a device for applying aggregate generally to a wall surface or other structural surfaces and the method of utilizing said device.

In the construction field of home and building erection and refinishing the placement of aggregate on exterior and interior walls and other surfaces has been both difficult and time consuming. Since a great deal of hand labor is required, the cost of such construction has been very expensive.

The use of exposed aggregate in building construction is well known in the art. Exposed aggregate, also known as aggregate surfacing or stone aggregate is aggregate purposefully exposed on the exterior and/or interior walls of a building or other surfaces for its color and texture. The aggregate is generally applied or embedded into a suitable material previously applied to the wall surface and generally known as a matrix. The matrix is usually of an epoxy or modified cement type, but may be of other types such a polyacryate, polyester, plaster, stucco, cement, mortar and other miscellaneous matrix. The surfaces to which exposed aggregate may be applied are many and are limited only by the choice of materials used in construction. Examples of some materials to which exposed aggregate may be applied are: concrete, brick, plaster, cement, asbestos board, wood, metal lath, block, composition board, metal and miscellaneous backing. The aggregate itself is generally of a stone type of material such as marble, quartz, pebbles, granite, man-made imitation stone and the like. The exposed aggregate method of surface finishing may be used in any number of ways. Some examples are: exterior and interior walls, building faces, window spandrels, facias, planters, store fronts, panels, contoured and irregular surfaces, outdoor works of art and the like.

In the past the method of applying aggregate known as seeding to a prepared surface has been by hand which is both slow, tedious and time consuming. And in these days of extremely high labor costs very expensive. The device of the present invention not only allows the reduction of seeding time by more than 50%, but it enables the builder to adhere to critical building schedules, do away with tedious hit and miss hand work and results in a uniform, accurate finished product. Even on complicated patterns and unusual shapes since the shape of the surface of the device may be previously designed to meet the needs of patterns and shapes to be surfaced. The prior art related to devices for applying stone to wall surfaces are:

U.S. Pat. No. 2,517,432, Aug. 1, 1950, F. L. Hornberger, Apparatus for Forming and Applying Stone Simulating Wall Finishes U.S. Pat. No. 2,810,180, Oct. 22, 1957, H. C. Barnack, Stone Mold Both of the above references relate to a method of molding a stone surface and then applying said molded stone to a surface. Neither describe a device or method for applying exposed aggregate as does the present invention.

DETAILED DESCRIPTION OF INVENTION

Figure 1:
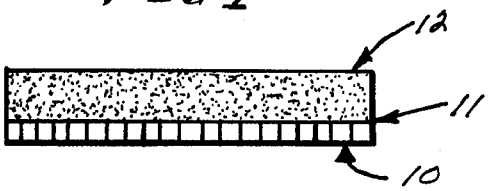

The present method used in the construction industry is installing exposed aggregate by hand. Since there is a limit to the amount of aggregate which can be picked up in the hand of the installer, applying the aggregate by this hand method technique makes the job very slow, very tedious and time consuming. The device and method of the present invention allow for the application of the aggregate at both a much faster rate and at a much more economical cost. Furthermore, the device of the present invention also makes it possible to apply aggregate more uniformly and in denser amount of stones per square foot.

In the method of the present invention, a number of devices are placed face upwards on a flat surface. The devices are placed flat next to each other. The aggregate is placed or poured on the resilient surface of the devices and leveled so that the aggregate is fairly evenly distributed on the devices.

It is essential to the device of the present invention that the resilient material forming the face of the device has sufficient resiliency to insure that aggregate that is placed thereon will not easily roll off the face of said device and yet in no way will inhibit the adhesion of the exposed aggregate on a prepared surface when applied. They may then stock one on top of the other near where the installer is working. The installer prepares the surface to receive the exposed aggregate by applying a matrix to the surface and while the matrix is still fresh, picks up the device of the present invention, swings it in a quick motion from a horizontal to a vertical position and presses it into the matrix. He continues to do this until the fresh matrix is covered with exposed aggregate.

While the installer again starts to trowel on the matrix, his assistant is preparing the devices of the present invention with aggregate so that they will be ready when the installer finishes the application of the next section of matrix. The procedure continues to be repeated. The result is a surface of uniform exposed aggregate, concentration and shape and a completed job in a time more than 50% less than required by hand application.

The device of the present invention consists essentially of a rigid to flexible like backing. This rigid to flexible backing material may be selected from any suitable material demonstrating the properties necessary for utilization of the device for any particular application. Examples of such materials are: rubber, metal, wood, paper, composition board, plastic, synthetic materials, fabric, and vinyl. In the preferred embodiment of the device of the present invention the backing material is hard, flexible rubber and said backing material may vary in thickness from about $\frac{1}{8}''$ to about 2" or more.

The face of the backing material is provided with a resilient type material such as: foam, rubber, sponge, fabric, synthetic materials, and paper.

In the preferred embodiment of the device of the present invention, the preferred material is polyurethane foam said resilient material is attached to the backing in a thickness of about $\frac{1}{4}''$ to 2" or more. Said resilient material is attached to said backing material by any suitable means. Examples of such attaching means are: contact cement, glue, mastic, latex, chemicals synthetic adhesives, organic and inorganic adhesives. The preferred embodiment of the device of the present invention is an adhesive such as contact cement.

The object of the present invention is to provide a device and method to allow for the seeding of exposed aggregate at a reduction of time of more than 50%.

An additional object of the present invention is to provide a device and method to reduce the cost of exposed aggregate facing in construction.

Figure 2:
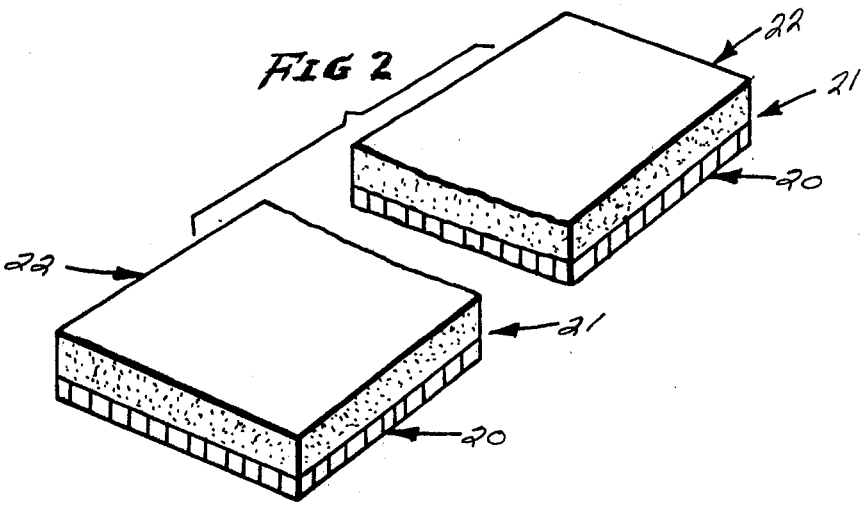

All of the foregoing and still further objects and advantages of the present invention will become apparent from a study of the following specification taken in connection with the accompanying drawing wherein like characters of reference designate corresponding parts through the several views and wherein:

FIG. 1 is a perspective view partly broken away of the device of the present invention; and FIG. 2 is a side elevation view of the device of the present invention.

In the drawings, the numeral 10 indicates generally the backing material, which is attached to resilient material 12 by attaching means 11. In FIG. 2 the numeral 20 generally indicates the backing material which is attached to resilient material 22 by attaching means 21.

Although several embodiments of the invention have been herein illustrated and described it will be evident to those skilled in the art that various modification may be made in the details of construction and method of application without departing from the spirit of the present invention as set forth and limited only by scope of the appended claims.

What is claimed is:

1. A method for applying exposed aggregate comprising providing a device for applying said aggregate, said device comprising a backing material attached to a facing material, said facing material having sufficient resiliency when said aggregate is placed thereon so that said aggregate by its weight, deforms said facing material thereby insuring that aggregate that is placed thereon will not easily roll off the face of said device even when tilted at an angle and in no way inhibit the adhesion of the exposed aggregate on the surface when applied, loading said aggregate on said resilient facing material of said device and arching said loaded device from a horizontal position against a vertical surface prepared to accept said aggregate resulting in partially imbedded aggregate in said prepared surface.

2. In the method of claim 1 where the bacing material is rigid.

3. In the method of claim 1 where the backing material is flexible.

4. In the method of claim 1 wherein said backing material has a stiffness lying between being rigid and flexible, a resilient facing material, said facing material having sufficient resiliency when said aggregate is placed thereon so that said aggregate, by its weight, deforms said facing material thereby insuring that aggregate that is placed thereon will not easily roll off the face of said device even when tilted at an angle and in no way inhibit the adhesion of the exposed aggregate on a surface when applied.

* * * * *